US010092114B2

(12) United States Patent
Camello et al.

(10) Patent No.: US 10,092,114 B2
(45) Date of Patent: Oct. 9, 2018

(54) PRODUCT DISPLAY UNIT WITH EXTENSION

(71) Applicant: Display Technologies, LLC, Lake Success, NY (US)

(72) Inventors: Anthony Camello, Staten Island, NY (US); Andrew Howard, Mamaroneck, NY (US); Daniel C. Riley, Hackensack, NJ (US)

( * ) Notice: Subject to any disclaimer, the term of this patent is extended or adjusted under 35 U.S.C. 154(b) by 0 days.

(21) Appl. No.: 14/697,941

(22) Filed: Apr. 28, 2015

(65) Prior Publication Data

US 2016/0316936 A1 Nov. 3, 2016

(51) Int. Cl.

| | |
|---|---|
| ***A47F 1/04*** | (2006.01) |
| ***A47F 7/00*** | (2006.01) |
| ***A47F 1/12*** | (2006.01) |
| ***A47B 73/00*** | (2006.01) |
| ***A47F 3/02*** | (2006.01) |
| *A47F 7/28* | (2006.01) |

(52) U.S. Cl.

CPC ..... *A47F 1/12* (2013.01); *A47B 73/00* (2013.01); *A47F 1/04* (2013.01); *A47F 3/02* (2013.01); *A47F 7/28* (2013.01)

(58) Field of Classification Search

CPC ..... A47F 5/0068; A47F 7/007; A47F 1/12; A47F 3/02; A47F 7/28; A47F 7/281; A47F 1/04; A47F 7/00; A47F 7/283; A47F 1/10; A47F 1/125; A47F 1/126; A47B 73/00; A47B 73/006; A47J 47/16

USPC ..... 211/59.2, 59.3, 119.003, 74, 126.1, 184, 211/49.1; 221/227, 255, 279; 312/61, 312/71, 35; 248/309.1; D6/408, 515

See application file for complete search history.

(56) References Cited

U.S. PATENT DOCUMENTS

| | | | | |
|---|---|---|---|---|
| 4,478,337 | A * | 10/1984 | Flum | A47F 1/12 206/564 |
| 4,685,574 | A | 8/1987 | Young et al. | |
| 4,763,963 | A | 8/1988 | Lauffer et al. | |
| 4,958,739 | A * | 9/1990 | Spamer | A47F 1/12 211/153 |
| 4,997,094 | A * | 3/1991 | Spamer | A47F 1/12 211/153 |
| 5,024,336 | A * | 6/1991 | Spamer | F16B 12/10 211/153 |
| 5,458,248 | A * | 10/1995 | Alain | A47B 45/00 211/153 |
| 5,634,564 | A * | 6/1997 | Spamer | A47F 1/126 211/175 |
| 6,082,556 | A * | 7/2000 | Primiano | A47F 1/12 211/59.2 |
| 6,325,221 | B2 * | 12/2001 | Parham | 211/183 |

(Continued)

OTHER PUBLICATIONS

International Search Report PCT/US14/55299 dated Dec. 19, 2014.

*Primary Examiner* — Jennifer E. Novosad

(74) *Attorney, Agent, or Firm* — Carter, DeLuca, Farrell & Schmidt, LLP

(57) ABSTRACT

A product display unit. The product display unit includes a base, a distal section, and an extension. The base includes a track that defines a longitudinal axis and that is configured to support a plurality of products thereon. The distal section is configured to releasably engage a distal portion of the base. The extension is configured to selectively engage the distal portion of the base.

19 Claims, 6 Drawing Sheets

(56) References Cited

U.S. PATENT DOCUMENTS

| | | | | |
|---|---|---|---|---|
| 6,439,402 | B2 * | 8/2002 | Robertson | A47F 7/28 211/187 |
| 6,478,167 | B1 * | 11/2002 | Burgess | A47F 1/12 211/59.2 |
| 6,523,702 | B1 * | 2/2003 | Primiano | A47F 1/12 211/175 |
| 6,615,995 | B2 * | 9/2003 | Primiano | A47F 1/12 211/175 |
| 6,695,152 | B1 * | 2/2004 | Fabrizio | A47F 1/12 211/175 |
| 6,715,621 | B2 * | 4/2004 | Boron | A47F 1/12 211/175 |
| 6,779,670 | B2 * | 8/2004 | Primiano | A47F 1/12 211/175 |
| 6,874,646 | B2 * | 4/2005 | Jay | A47B 96/021 211/175 |
| 6,886,699 | B2 * | 5/2005 | Johnson | A47F 1/126 108/61 |
| 8,016,139 | B2 * | 9/2011 | Hanners | A47F 5/005 211/184 |
| 8,162,154 | B2 | 4/2012 | Trulaske, Sr. | |
| 8,851,303 | B2 * | 10/2014 | Crawbuck | A47F 1/12 211/59.2 |
| 8,863,963 | B2 * | 10/2014 | Hardy | A47F 1/126 211/119.003 |
| 9,107,516 | B2 * | 8/2015 | Pichel | A47F 1/04 |
| 2001/0002658 | A1 * | 6/2001 | Parham | A47F 1/12 211/59.2 |
| 2004/0065631 | A1 | 4/2004 | Nagel | |
| 2011/0094980 | A1 * | 4/2011 | Cousin | A47F 5/005 211/59.2 |

* cited by examiner

PRODUCT DISPLAY UNIT WITH EXTENSION

BACKGROUND

The present disclosure relates to a product display unit, and more particularly, to an inclined product display unit having a distal extension configured to change a length of the product display unit.

Various types of product display units and merchandisers are commonly used in retail environments to display different types of products. As opposed to simply positioning products on shelves, product display units are commonly used to position products on a shelf in manner which automatically advances (e.g., via gravity or a pusher) a trailing or distal product (i.e., a product that is behind a lead or proximal-most product) closer to a consumer once the lead product has been removed from the shelf. As can be appreciated, such product display units facilitate the arrangement and upkeep of products, as the trailing products do not have to be manually moved toward the front of the shelf, for instance.

Additionally, in retail environments, for example, floor/shelf space is limited, and retailers typically attempt to maximize the amount of products they can store/display in their retail space. Further, retailers and other users of product display units often use products display units of different sizes to fit on a variety of types and sizes of shelves and cabinets, for example. Such users of product display units must typically stock a variety of sizes of display units to ensure they have enough product display units to accommodate displaying a variety of goods.

Accordingly, it is often desirable for retailers to display products in as many viewable and reachable places as possible, while still allowing the products to automatically advance toward the proximal portion of the shelf. It is also desirable for retailers to be able to use product display units on a variety of sizes of shelves without the need to stock different sizes of product display units.

SUMMARY

The present disclosure relates to a product display unit. The product display unit includes a base, a distal section, and an extension. The base includes a track and a distal portion, the track defines a longitudinal axis and that is configured to support a plurality of products thereon. The distal section and the extension are configured to releasably engage the distal portion of the base.

It is also disclosed that the distal portion of the base includes at least one connection member for engaging at least one connection member of the extension.

It is further disclosed that the distal portion of the base includes two connection members, and that each connection member of the two connection members of the distal portion of the base is configured to engage a connection member of the extension.

In disclosed embodiments, the distal portion of the base includes at least one female connection member configured to engage at least one male connection member of the extension. It is further disclosed that the at least one female connection member of the distal portion of the base includes a longitudinal nub configured to engage a lateral surface of the at least one male connection member of the extension. It is also disclosed that the lateral surface of the at least one male connection member includes a protrusion configured to engage the longitudinal nub of the at least one female connection member of the distal portion of the base. It is further disclosed that a distal surface of the protrusion is configured to contact a proximal surface of the longitudinal nub when the extension is engaged with the distal portion of the base.

In disclosed embodiments, the extension defines a length along the longitudinal axis, the length being between about 6 inches and about 18 inches.

It is further disclosed that the extension is configured to selectively disengage the distal portion of the base, and that the extension includes a track configured to support at least one product thereon.

The present disclosure also relates to a product display kit including a base, and a plurality of extensions. The base includes a track and a distal portion. The track defines a longitudinal axis and is configured to support a plurality of products thereon. Each extension of the plurality of extensions is configured to selectively engage the distal portion of the base.

In disclosed embodiments, the plurality of extensions includes two extensions, and each extension of the two extensions includes a different length. It is disclosed that a first extension of the two extensions includes a length of between about 6 inches and about 12 inches, and a second extension of the two extensions includes a length of between about 12 inches and about 18 inches.

In disclosed embodiments, each extension of the plurality of extensions is configured to selectively disengage the distal portion of the base.

It is further disclosed that each extension of the plurality of extensions includes a track configured to support at least one product thereon.

It is also disclosed that the distal portion of the base includes at least one connection member for engaging at least one connection member of each extension of the plurality of extensions.

Additionally, it is disclosed that the distal portion of the base includes two connection members, where each connection member of the two connection members of the distal portion of the base is configured to engage a connection member of each extension of the plurality of extensions.

In disclosed embodiments, the distal portion of the base includes at least one female connection member configured to engage at least one male connection member of each extension of the plurality of extensions.

BRIEF DESCRIPTION OF THE DRAWINGS

Embodiments of the present disclosure are described hereinbelow with reference to the drawings wherein.

DETAILED DESCRIPTION

Figure 1:
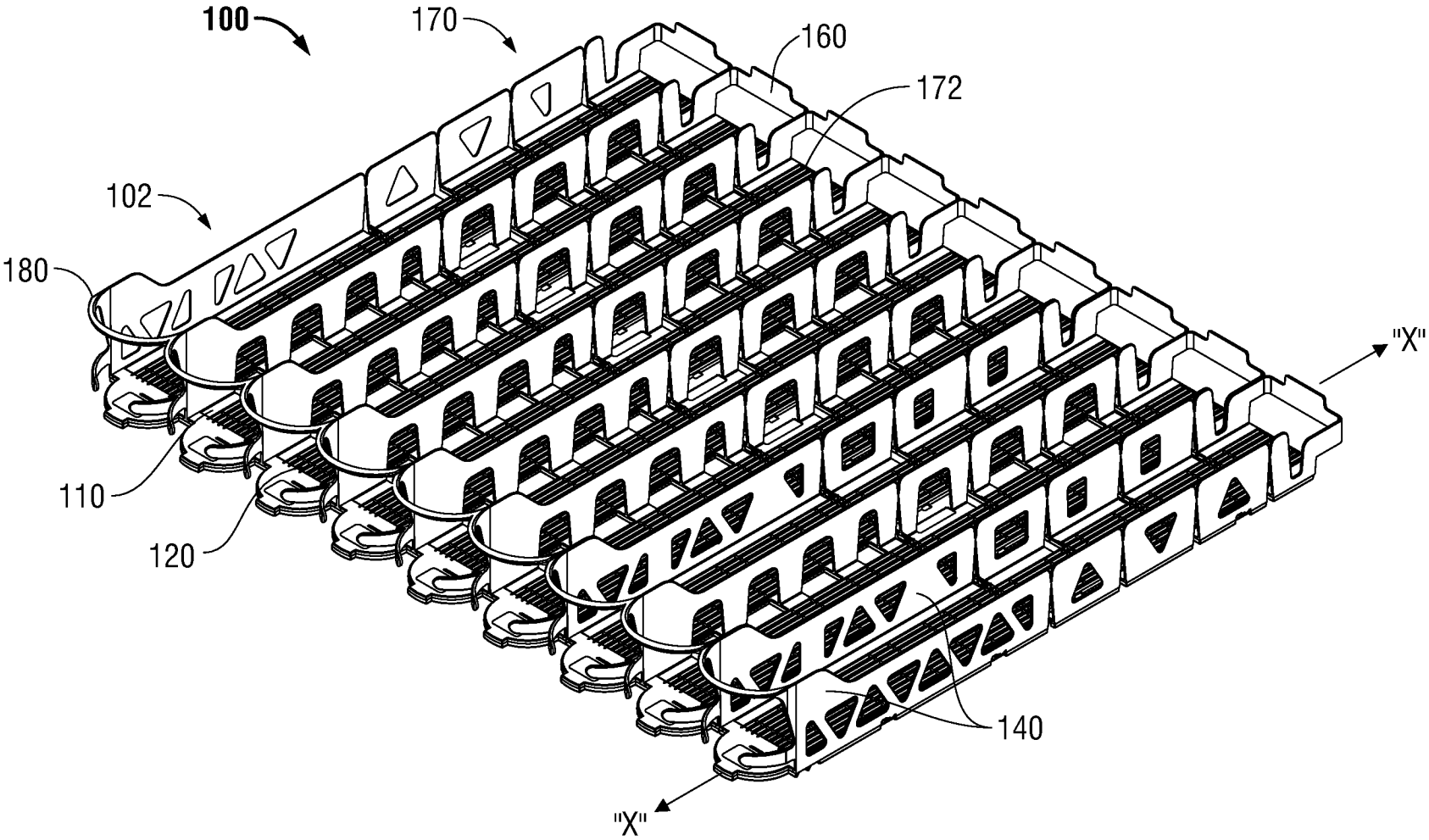
FIG. 1 is a perspective view of a plurality of product display units in accordance with embodiments of the present disclosure.
Figure 2:
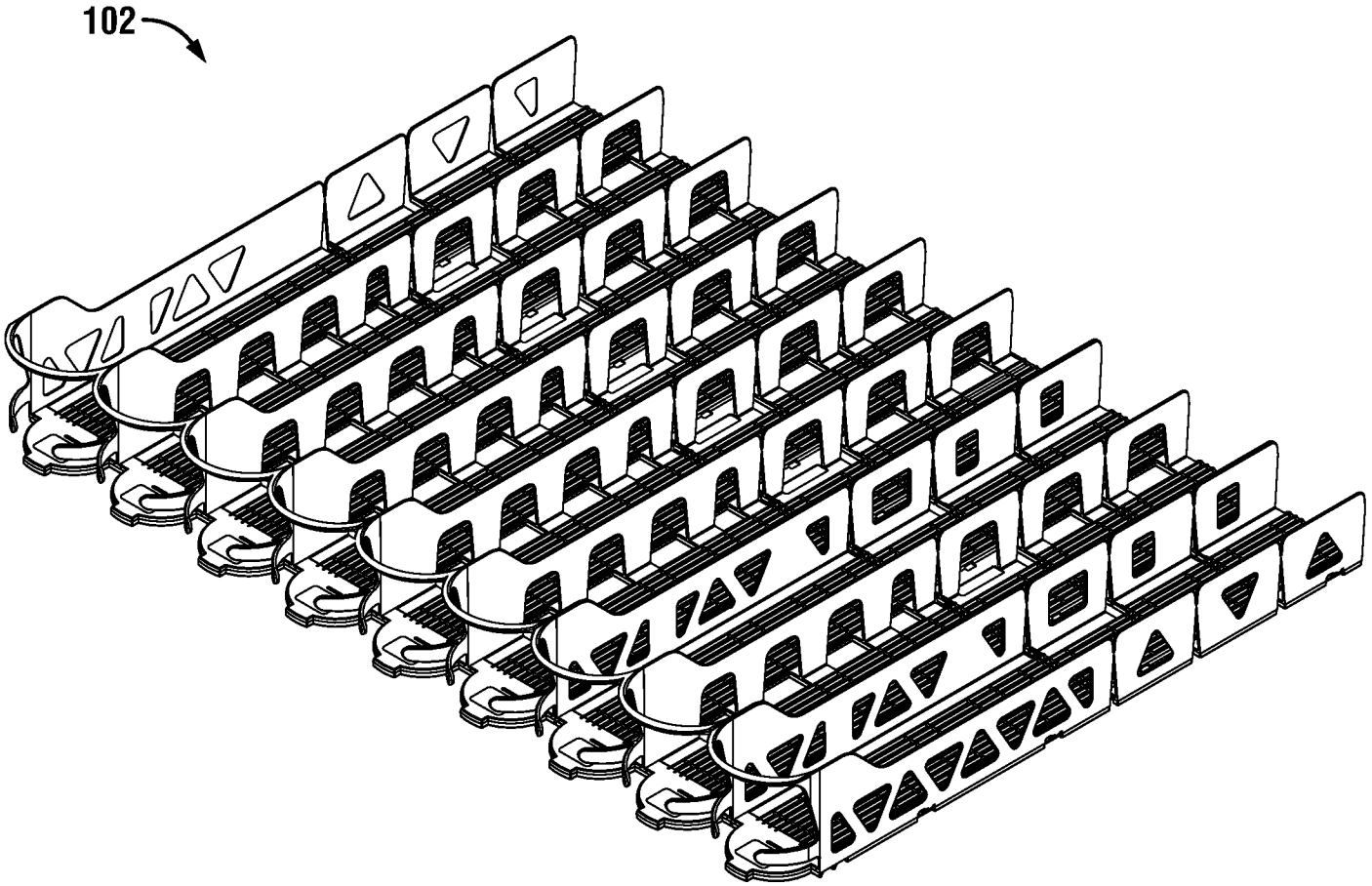
FIG. 2 is a perspective view of the plurality of product display units shown in FIG. 1 with a distal section of each product display unit removed.

Embodiments of the presently disclosed product display unit are now described in detail with reference to the drawings, in which like reference numerals designate identical or corresponding elements in each of the several views. As used herein the term "distal" refers to that portion of the product display unit, or component thereof, farther from a user (e.g., customer), while the term "proximal" refers to that portion of the product display unit, or component thereof, closer to the user.

Various embodiments of a product display unit are illustrated in FIGS. 1-8 and are generally referenced by numeral 100. Each product display unit 100 includes a base 102, a distal section 170, and at least one extension 200. Each of the base 102, the distal section 170, and the extension 200 includes a bottom member having a track, and a pair of sidewalls. More particularly the base 102 includes a bottom member 110, a track 120 and sidewalls 140. The distal section 170 includes a bottom member 171, a track 172 and sidewalls 173. The extension 200 includes a bottom member 201, a track 202 and sidewalls 203. The base 102 also includes a proximal member 180. The distal section 170 includes a distal member 160, and the extension 200 includes a distal member 260.

The tracks 120, 172, 202 include a product-supporting surface and are configured to slidably support a plurality of products thereon. That is, products are slidable along the tracks 120, 172, 202. For example, gravity urges products to slide along the tracks 120, 172, 202 in a distal-to-proximal direction. In such gravity feed arrangements, a distal portion of the track is elevated with respect to a proximal portion of the track, such that gravity urges the products toward proximal member 180. With particular reference to FIG. 1, the track 120 defines a longitudinal axis "X."

The sidewalls 140, 173, 203 are disposed at both lateral sides of the respective tracks 120, 172, 202 and are configured to help maintain products on the respective tracks 120, 172, 202. As shown in FIG. 1, for example, when a plurality of product display units 100 is positioned adjacent one another to form a product display assembly 1000, it is envisioned that adjacent product display units 100 share common sidewalls 140, 173, 203. Alternatively, each product display unit 100 may include a pair of sidewalls 140, 173, 203 such that, when connected to another product display unit 100, the sidewalls 140, 173, 203 are in an abutting relationship.

The proximal member 180 is positioned adjacent the front or proximal portion of the track 120 and is configured to help maintain products on the track 120. More specifically, the proximal member 180 helps prevent a proximal-most product from falling proximally off of the track 120. Additionally, the proximal member 180 opposes the gravitational force and/or the force supplied by a pusher (not shown). Further, while the illustrated embodiments include a certain type of proximal member 180, the present disclosure includes the use of any suitable type and number of proximal members 180 per product display unit 100.

The distal members 160, 260 are configured to help maintain products on tracks 172, 202, respectively. More particularly, the distal member 160 is configured to help prevent a distal-most product from falling distally off of the track 172 of the distal section, and the distal member 260 is configured to help prevent a distal-most product from falling distally off of the track 202 of the extension 200.

Figure 8:
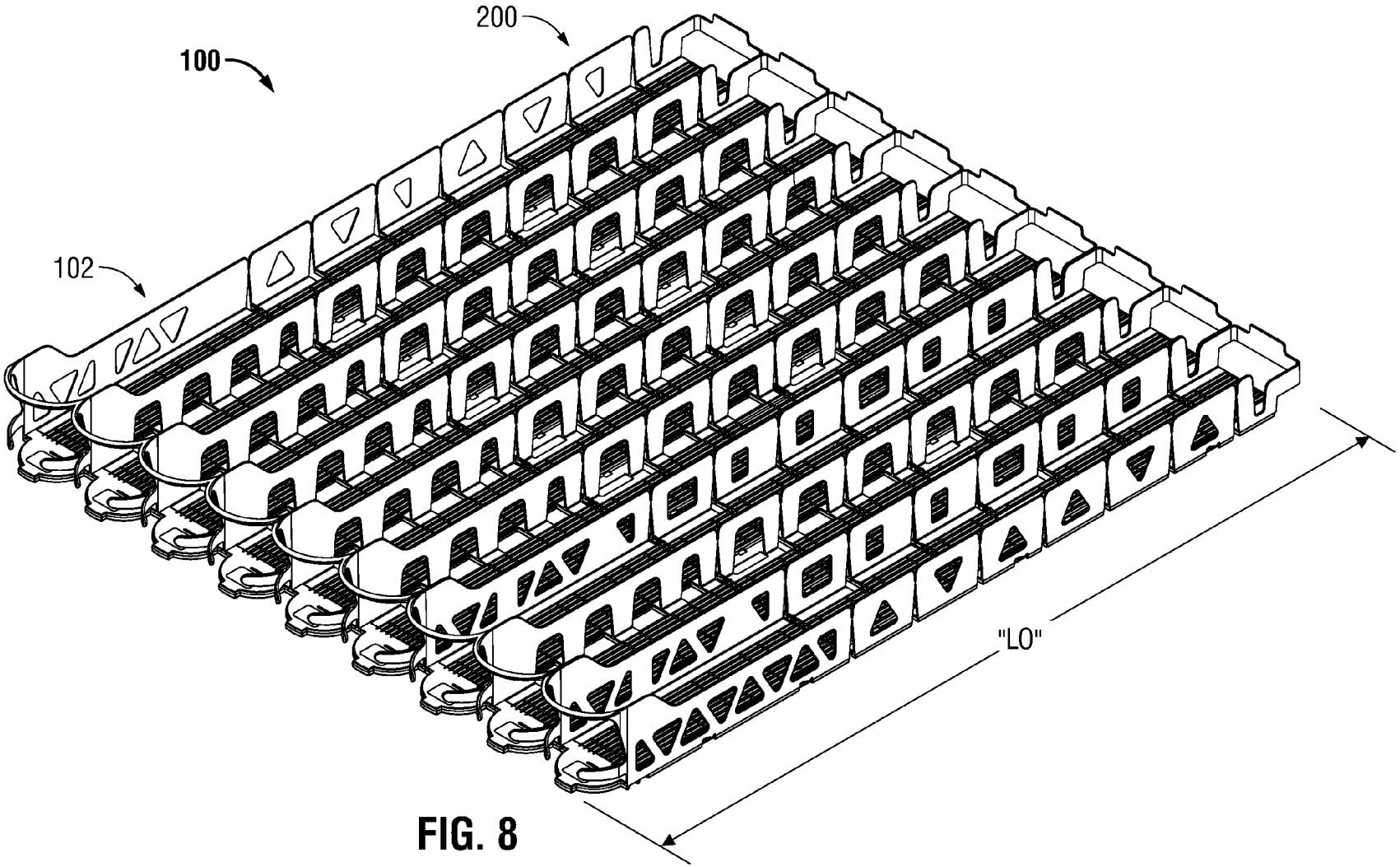
FIG. 8 is a perspective view of the plurality of product display units shown in FIG. 2 engaged with the plurality of extensions shown in FIG. 5.

The distal section 170 of product display unit 100 is selectively removable from the base 102 of the product display unit 100. After the distal section 170 has been removed, the extension 200 is selectively engageable and disengageable with the base 102 of the product display unit 100, as described in detail below. As can be appreciated, extensions 200 that are a different length "LE" (FIG. 6) than a length of the distal section 170, change the overall length "LO" of product display unit 100 (FIG. 8).

Figure 3:
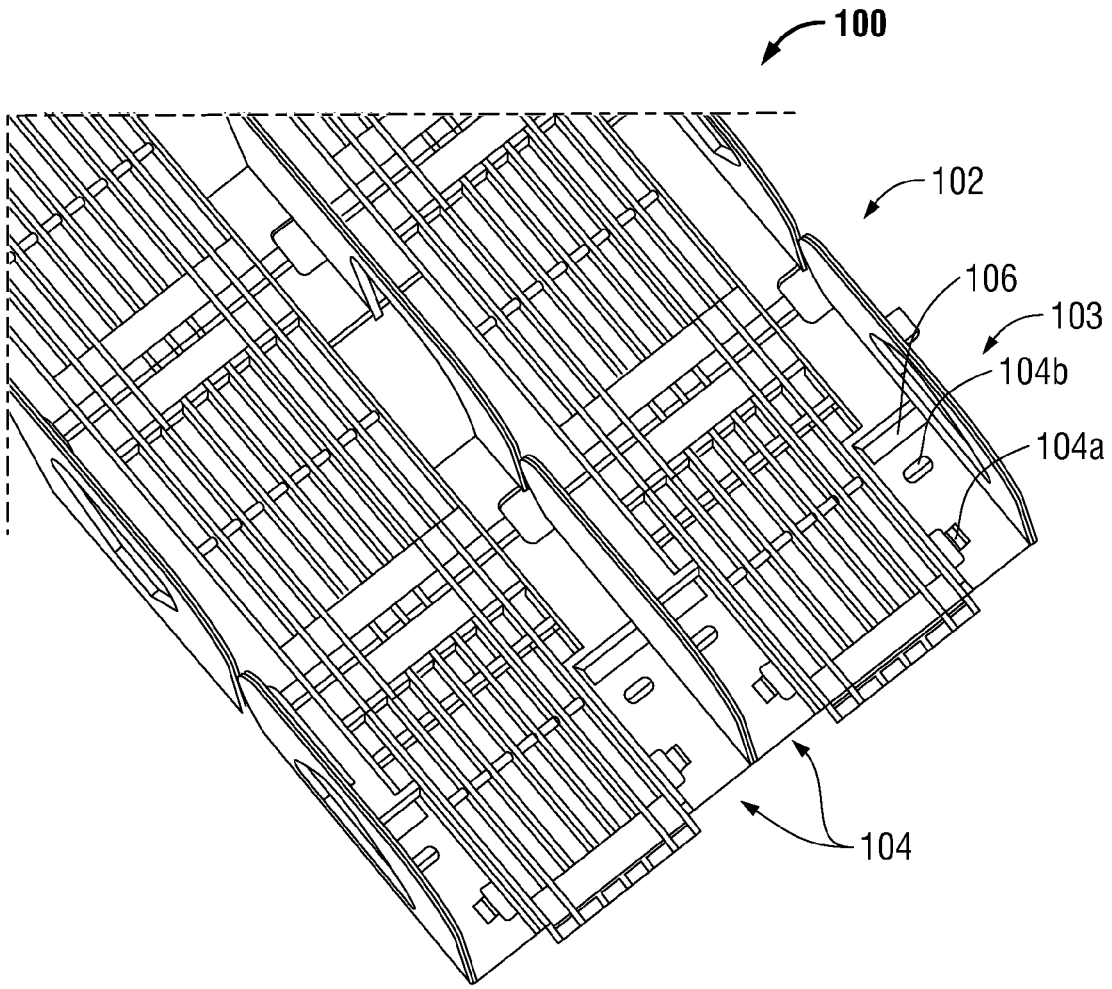
FIG. 3 is a perspective view of a distal portion of two of the product display units of FIGS. 1 and 2 with the distal section of each product display unit removed.
Figure 4:
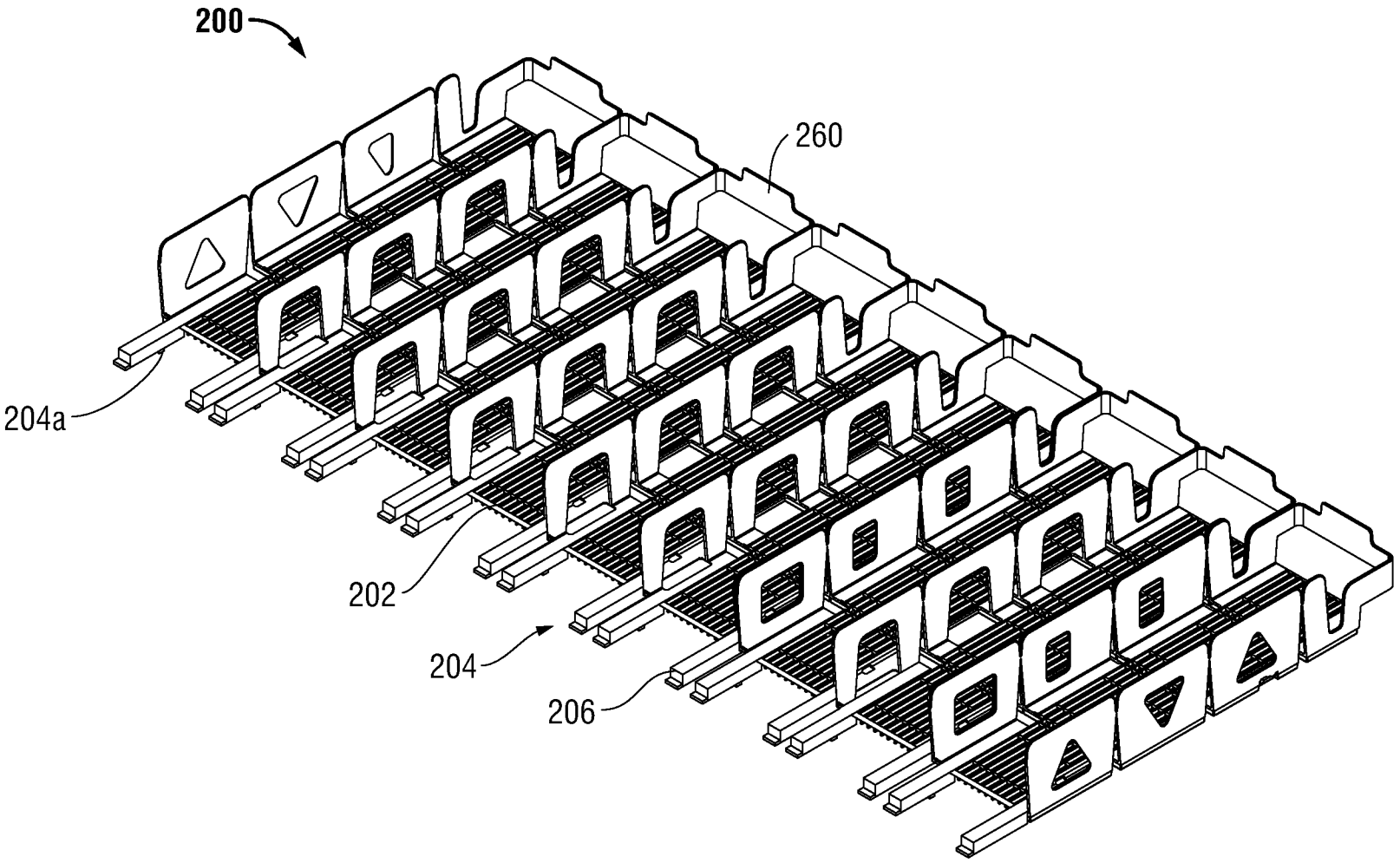
FIG. 4 is a perspective view of a plurality of extensions for use with the product display units of FIGS. 1-3.
Figure 6:
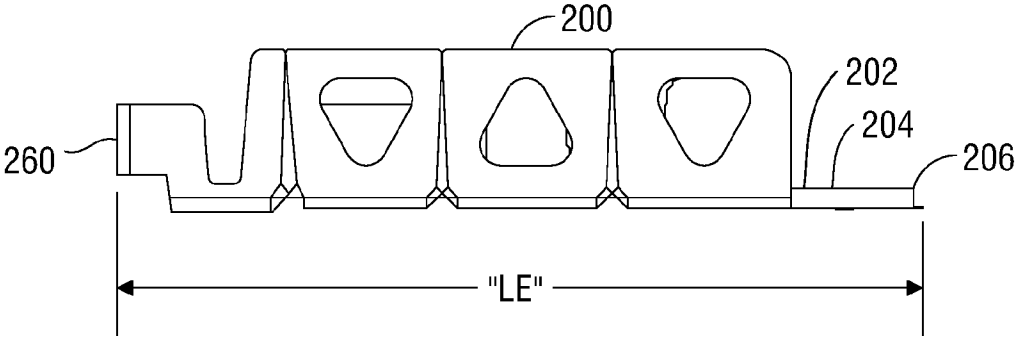
FIG. 6 is a side view of one of the extensions of FIG. 5.
Figure 7:
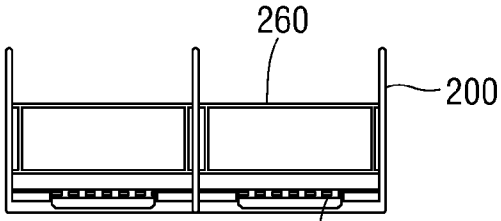
FIG. 7 is a front view of two of the extensions of FIG. 6.
Figure 5:
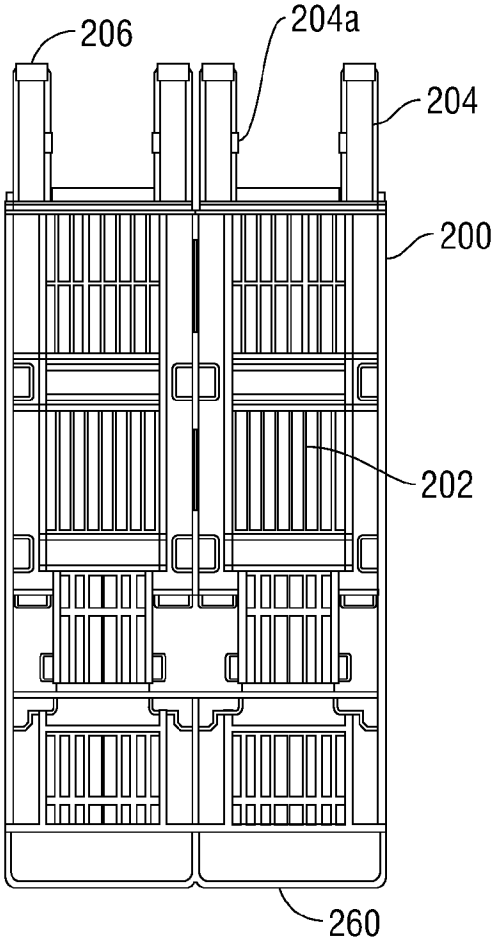
FIG. 5 is a top view of two of the extensions of FIG. 4.

Referring now to FIG. 3, a distal portion 103 of the base 102 of the product display unit 100 includes a pair of first connection members (e.g. female connection members) 104, each of which being configured to selectively and releasably engage a second connection member (e.g., male connection member) 204 of the extension 200 (FIG. 4).

In use, to engage the extension 200 with the base 102 of the product display unit 100, male connection members 204 are aligned with and moved into engagement with female connection members 104. In particular, a proximal tip 206 of each male connection member 204 is moved into an aperture 106 of each female connection member 104, thereby providing frictional engagement therebetween. Generally, to disengage the extension 200 from the base 102, a user pulls the extension 200 distally with respect to the base 102 and/or physically disengages the male connection members 204 from the female connection members 104.

To further enhance the frictional engagement between the base 102 and the extension 200, the female connection members 104 include a longitudinal nub **104*a* (see FIG. 3). The longitudinal nub 104*a* is positioned on the lateral side of the female connection member 104 that is closest to the longitudinal center of the product display unit 100, and is configured to engage a protrusion 204*a* of the male connection member 204 (see FIG. 4). More particularly, the protrusion 204*a* is configured to be positioned proximally of and/or in contact with the longitudinal nub 104*a*, such that proximal movement of the extension 200 with respect to the base 102 is hindered. To facilitate engagement between the extension 200 and the base 102, and in particular between the male connection member 204 and the female connection member 104, a user may elevate a portion (e.g., a distal portion) of extension 200 with respect to the female connection member 104 to help guide the protrusions 204*a* over the longitudinal nubs 104*a*, to help allow the protrusions 204*a* to move proximally past the longitudinal nubs 104*a***.

It is also envisioned that proximal and/or distal surfaces of longitudinal nubs **104*a* and/or protrusions 204*a* include an angled surface to help facilitate engagement and/or disengagement between base 102 and extension 200. Additionally, it is envisioned that male connection members 204 are sufficiently flexible to flex a sufficient distance with respect to the longitudinal axis (toward and/or away from the longitudinal axis) to further facilitate engagement between male connection members 204 and female connection members 104**.

With continued reference to FIG. 3, female connection members 104 are also shown including a transverse nub **104*b*. It is envisioned that transverse nub 104*b* engages a groove (not explicitly shown) disposed on a lower surface of the male connection member 204. The engagement between the transverse nub 104*b* and the groove may help to further maintain the engagement between female connection members 104 and male connection members 204**.

While the illustrated embodiments show each of the product display units 100 including the base 102 with two female connection members 104 and the extension 200 with two male connection members 204, it is envisioned that each product display unit 100 includes more or fewer female connection members 104 and/or male connection members 204. It is also envisioned that the base 102 includes male extension members 204 and the extension 200 includes female extension members 104.

It is envisioned that the length "LE" of the extension 200 is between about 6 inches and about 18 inches, or any other suitable length. It is further envisioned that the extension 200 can be configured to engage with any number of adjacent bases 102. For instance, the extension 200 can be configured to engage base 102 including one product display unit 100, two adjacent product display units 100 (FIG. 3), nine adjacent product display units 100 (FIGS. 1, 2, 4, and 8), or any other suitable number of adjacent product display units 100.

The present disclosure also relates to a product display kit including the base 102, the distal section 170, and at least one extension 200. It is further envisioned that the product display kit includes a plurality of extensions 200 with each extension 200 having a different length "LE." For instance, disclosed product display kits include a first extension having a length "LE" of about 6 inches, a second extension having a length "LE" of about 12 inches, and a third extension having a length "LE" of about 18 inches. As can be appreciated, such product display kits enable retailers a great amount of flexibility with regards to where (e.g. depending on the length or type of shelve and cabinet) the product display unit 100 can be utilized.

Further, while the accompanying figures illustrate a particular number of product display units 100 disposed adjacent each other, it is envisioned and within the scope of the present disclosure to include more or fewer amounts of product display units 100, and to include product display units 100 of other sizes, and disposed at different angles than those illustrated, for example. Additionally, the present disclosure contemplates the use of a pusher assembly to urge products proximally on the tracks 120, 172, 202 (e.g., when the slope of the shelf supporting the product display unit 100 is insufficient to urge the products proximally via gravity).

Further details of related product display units are described in commonly-owned U.S. Pat. No. 5,645,176, which issued on Jul. 8, 1997, the entire contents of which being incorporated by reference herein.

It will be understood that various modifications may be made to the embodiments disclosed herein. Therefore, the above description should not be construed as limiting, but merely as exemplifications of various embodiments. Those skilled in the art will envision other modifications within the scope and spirit of the claims appended hereto.

The invention claimed is:

1. A product display unit, the product display unit comprising:

a base including a track and a distal portion, the track defining a longitudinal axis and configured to support a plurality of products thereon, the plurality of products is configured to be guided from a distal portion of the track toward a proximal portion of the track;

a distal section including a track and a distal member, the distal member of the distal section extending generally perpendicularly to the longitudinal axis and configured to help maintain a product on the track of the distal section, wherein an upper edge of the distal member of the distal section is disposed above an upper edge of the track of the distal section, wherein the distal member of the distal section is free from contact with a proximal portion of the track of the distal section; and an extension including a track and a distal member, the distal member of the extension extending generally perpendicularly to the longitudinal axis and configured to help maintain a product on the track of the extension, wherein an upper edge of the distal member of the extension is disposed above an upper edge of the track of the extension, wherein the distal section and the extension are configured to releasably engage the distal portion of the base, and wherein engagement between the distal section and the distal portion of the base physically prevents engagement between the extension and the distal portion of the base.

2. The product display unit according to claim 1, wherein the distal portion of the base includes at least one connection member for engaging at least one connection member of the extension.

3. The product display unit according to claim 1, wherein the distal portion of the base includes two connection members, each connection member of the two connection members of the distal portion of the base is configured to engage a connection member of the extension.

4. The product display unit according to claim 1, wherein the distal portion of the base includes at least one female connection member configured to engage at least one male connection member of the extension.

5. The product display unit according to claim 1, wherein the extension defines a length along the longitudinal axis, the length being between about 6 inches and about 18 inches.

6. The product display unit according to claim 1, wherein the extension is configured to selectively disengage the distal portion of the base.

7. The product display unit according to claim 1, wherein the distal section includes a first sidewall and a second sidewall disposed on opposite sides of the track of the distal section, wherein the distal member of the distal section extends from the first sidewall of the track of the distal section to the second sidewall of the track of the distal section, wherein the extension includes a first sidewall and a second sidewall disposed on opposite sides of the track of the extension, and wherein the distal member of the extension extends from the first sidewall of the track of the extension to the second sidewall of the track of the extension.

8. The product display unit according to claim 1, wherein the distal member of the distal section is free from contact with the track of the distal section.

9. The product display unit according to claim 1, wherein the distal section includes a first sidewall disposed along a first lateral portion of the track of the distal section and a second sidewall disposed along a second lateral portion of the track of the distal section, wherein the distal member of the distal section is in contact with the first sidewall and the second sidewall.

10. A product display kit comprising:

a base including a track and a distal portion, the track defining a longitudinal axis and configured to support a plurality of products thereon, the plurality of products is configured to be guided from a distal portion of the track toward a proximal portion of the track, the distal portion of the base disposed at the distal portion of the track; and a plurality of extensions, each extension of the plurality of extensions including a track and a distal member, the distal member of each extension of the plurality of extensions extends generally perpendicularly to the longitudinal axis, is free from contact with a proximal portion of the track of the extension, and is configured to help maintain a product on the track thereof, wherein each extension of the plurality of extensions is configured to selectively engage the distal portion of the base, and wherein engagement between one extension of the plurality of extensions and the distal portion of the base physically prevents engagement between another extension of the plurality of extensions and the distal portion of the base.

11. The product display kit according to claim 10, further comprising a distal section configured to releasably engage the distal portion of the base.

12. The product display kit according to claim 10, wherein the plurality of extensions includes two extensions, and wherein each extension of the two extensions includes a different length.

13. The product display kit according to claim 12, wherein a first extension of the two extensions includes a length of between about 6 inches and about 12 inches, and wherein a second extension of the two extensions includes a length of between about 12 inches and about 18 inches.

14. The product display kit according to claim 10, wherein each extension of the plurality of extensions is configured to selectively disengage the distal portion of the base.

15. The product display kit according to claim 10, wherein each extension of the plurality of extensions includes a track configured to support at least one product thereon.

16. The product display kit according to claim 10, wherein the distal portion of the base includes at least one connection member for engaging at least one connection member of each extension of the plurality of extensions.

17. The product display kit according to claim 10, wherein the distal portion of the base includes two connection members, each connection member of the two connection members of the distal portion of the base is configured to engage a connection member of each extension of the plurality of extensions.

18. The product display kit according to claim 10, wherein the distal portion of the base includes at least one female connection member configured to engage at least one male connection member of each extension of the plurality of extensions.

19. A product display unit, the product display unit comprising:

a base including a track, a distal portion and at most two sidewalls on said base, the track defining a longitudinal axis and configured to support a plurality of products thereon, the plurality of products is configured to be guided from a distal portion of the track toward a proximal portion of the track, each sidewall of the at most two sidewalls is disposed along a lateral portion of the track and extends parallel to the longitudinal axis;

a distal section including a track and a distal member, the distal member of the distal section extending generally perpendicularly to the longitudinal axis and configured to help maintain a product on the track of the distal section, wherein an upper edge of the distal member of the distal section is disposed above an upper edge of the track of the distal section, wherein the distal section includes a first sidewall disposed along a first lateral portion of the track of the distal section and a second sidewall disposed along a second lateral portion of the track of the distal section, wherein the distal member of the distal section is in contact with the first sidewall of the distal section and the second sidewall of the distal section; and an extension including a track and a distal member, the distal member of the extension extending generally perpendicularly to the longitudinal axis and configured to help maintain a product on the track of the extension, wherein an upper edge of the distal member of the extension is disposed above an upper edge of the track of the extension, and wherein the distal section and the extension are configured to releasably engage the distal portion of the base.

* * * * *